United States Patent [19]

Hsueh

[11] Patent Number: 4,880,398

[45] Date of Patent: Nov. 14, 1989

[54] FUSE HOLDER FOR HOLDING A FLAT-TYPE FUSE BLOCK

[76] Inventor: Fu-Cheng Hsueh, No. 1045, Jen-Ai Tsun,, Jen-Te Hsiang, Tainan Hsien, Taiwan

[21] Appl. No.: 233,136

[22] Filed: Aug. 17, 1988

[51] Int. Cl.[4] ..... H01R 33/95

[52] U.S. Cl. ..... 439/622; 439/629; 439/595

[58] Field of Search ..... 439/621, 622, 651, 733, 439/682, 845, 59–62, 629, 595

[56] References Cited

U.S. PATENT DOCUMENTS

| | | | |
|---|---|---|---|
| 2,807,790 | 9/1957 | Del Camp | 439/682 |
| 3,484,864 | 12/1969 | Bernstein et al. | 439/651 |
| 3,524,161 | 8/1970 | Frantz et al. | 439/629 |
| 4,372,638 | 2/1983 | Sohler | 439/621 |
| 4,391,485 | 7/1983 | Urani | 439/621 |
| 4,556,274 | 12/1985 | Olivera | 439/621 |
| 4,560,227 | 12/1985 | Bukala | 439/621 |
| 4,744,771 | 5/1988 | Uchida | 439/733 |

FOREIGN PATENT DOCUMENTS

| | | | |
|---|---|---|---|
| 2511459 | 9/1976 | Fed. Rep. of Germany | 439/622 |
| 1241857 | 8/1971 | United Kingdom | 439/629 |
| 2141294 | 12/1984 | United Kingdom | 439/733 |

*Primary Examiner*—Gary F. Paumen

*Attorney, Agent, or Firm*—Limbach, Limbach & Sutton

[57] ABSTRACT

A fuse holder for holding a flat-type fuse block comprises a housing adapted to accept a flat-type fuse block, and a pair of female terminals disposed within the housing and adapted to mate with a pair of male terminals of the fuse block. The pair of female terminals have a pair of connectors extended therefrom in a vertical direction perpendicular to the broader side of the flat body of the fuse block. The housing has at least one plane which has at least one slot for receiving and enabling the passing through of the connectors. A pair of fixing plugs formed on the plane which are passed through by the pair of connectors can insert in to a pair of predetermined holes on a flat board so as to attach the housing of the fuse block onto the board allowing the fuse holder to occupy a minimum of space both horizontally and vertically above the board.

5 Claims, 3 Drawing Sheets

FUSE HOLDER FOR HOLDING A FLAT-TYPE FUSE BLOCK

BACKGROUND OF THE INVENTION

The present invention relates to a fuse holder for holding a flat-type fuse block. More particularly, the present invention relates to a fuse holder for holding a flat-type fuse block, which can be fitted with ease and occupies minimum space.

Conventionally, a cartridge fuse mounted on a fuse block is often applied in domestic electric appliances or in the electric circuitry of cars. One end of the cartridge fuse is connected to a load, such as an electric lamp, or an electric fan, and the other end of the cartridge fuse is connected to a power supply, such as a receptacle, or a battery. The fuse design allows the cartridge fuse of the fuse block to interrupt the circuit to which it is connected in order to protect said circuit when an overload occurs.

FIG. 1 is a perspective view showing a fuse holder for holding a cartridge fuse which comprises a shell body 11, a top cap 12, a washer 13, a screw nut 14, a cartridge fuse 15 and a pair of terminals 16, 17. The cartridge fuse 15 is installed in the hollow chamber of the shell body 11 and is covered by the top cap 12 which is screwed onto the shell body 11. The pair of terminals 16, 17 extend respectively from the end of the shell body 11 and the sidewall of the shell body 11 so as to be soldered with wires. The fuse holder can be fitted in a predetermined hole of a broad A and fixed by screwing a screw nut 14 with a washer 13 riding on top until said washerr 13 is in contact with the board A. Finally, a fuse holder installed in a board with a high protrusion above the plane of the board is obtained, requiring the removal of the top cap to see whether the fuse in the fuse holder is good.

As shown in FIG. 2, a flat-type of fuse block P is applied in a base which contains a predetermined number of circuits therein. Such fuses in different current loads can plug into the base separately to connect the circuits preset in the base. However, such a fuse is not suitable for a separate circuit or a circuit which must be able to be rearranged on a circuit board due to the fact that said flat-type fuse block occupies a lot of space both horizontally and vertically on the circuit board.

SUMMARY OF THE INVENTION

It is a primary object of the present invention to provide a fuse holder for holding a flat-type fuse block, which is typically suitable for a separate circuit, can be rearranged on a circuit board and occupies a minimum space both horizontally and vertically on the circuit board on which the fuse holder is fitted.

It is another object of the present invention to provide a fuse holder which has a notch formed thereon to allow observation of a fuse in the flat-type fuse block fitted in the fuse holder.

Accordingly, the fuse holder for holding a flat-type fuse block having a flat body which has two broader sides separated by a series of narrower sides, a pair of male terminals correspondingly, vertically and outwardly protruded via one narrower side of the flat body from its inside, and a fuse disposed inside the flat body and connected between the pair of male terminals comprising a housing which is adapted to accept said fuse block and said pair of male terminals, said housing having at least one flat plane which has at least one slot opened thereon, and a pair of female terminals disposed within said housing and adapted to mate with said pair of male terminals, each female terminal having a connector extending perpendicular to the flat plane, passing through said slot. Preferably, said housing is hollow and flat having two broader sides separated by a series of narrower sides, one narrower side of said housing being opened for inserting said fuse block, one broader side of the housing having a slot for receiving said connectors and enabling them to pass through, said slot is substantially parallel to the opened side of the housing, and there is a notch connecting said slot and the opened side of the housing to let said connectors pass into said slot. A pair of fixing plugs formed in the two ends of said slot are respectively passed through by each end of the slot so that each connector of said pair of female terminals can extend out through each fixing plug. Said pair of fixing plugs of the housing can be inserted through a pair of holes preset on a circuit board to attach the broader plane of the housing onto one side of the circuit board so that the housing of the fuse holder will occupy minimum space hoizontally and vertically on the circuit board.

These and other objects, features and advantages of the present invention will be more apparent in the following description of a preferred embodiment with reference to the accompanying drawings.

DETAILED DESCRIPTION OF THE PREFERRED EMBODIMENT

Figure 1:
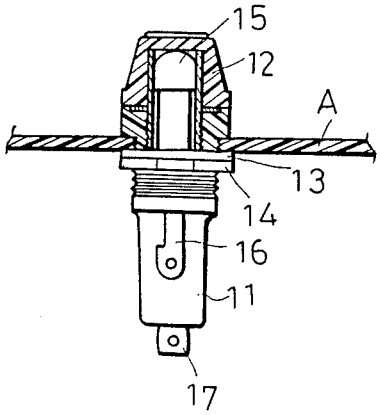
FIG. 1 (PRIOR ART)
FIG. 1 is a prospective view of a conventional fuse holder for holding a cartridge fuse.
Figure 2:
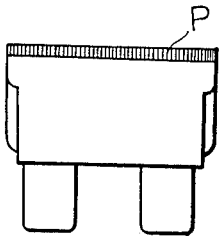
FIG. 2 (PRIOR ART)
FIG. 2 is a top view of a conventional flat-type fuse block.
Figure 3:
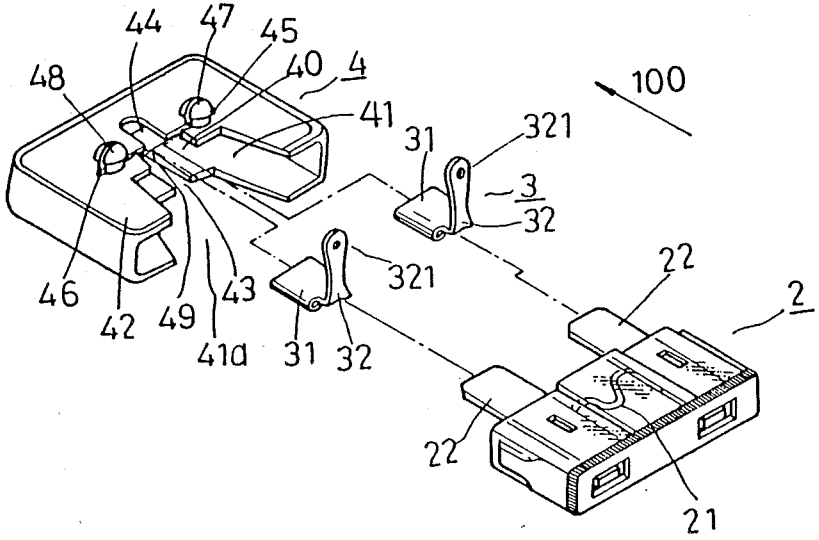
FIG. 3 is an exploded perspective view of a preferred embodiment of the fuse holder in accordance with the present invention.
Figure 4:
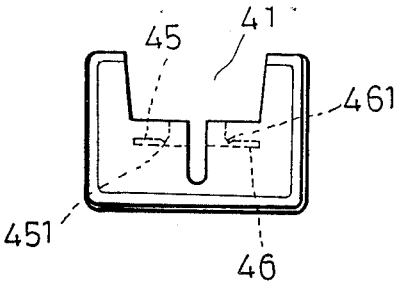
FIG. 4 is a top view of a housing of the fuse holder of FIG. 3.

Referring to FIG. 3, an exploded perspective view of a fuse holder for holding a flat-type fuse block 2 comprises a pair of female terminals 3 and a housing 4. The flat-type of fuse block 2 has a flat body which has two broader sides separated by a series of narrower sides, a pair male terminals 22,22 correspondingly, vertically and outwardly perotruding in the same direction of arrow 100 via one narrower side of the flat body from its inside, and a fuse 21 disposed inside of the flat body and connected between the pair of male terminals 22, 22. The fuse block is typically made of plastic materials. Each female terminal 32 comprises a clip portion 31 which is a rectangular plate with two opposed curved sides so as to clamp one of said pair of male terminals 22 of the fuse block 2 and a connector 32 extending vertically from one side of said rectangle plate. Each end of the connectors 32 has a hole 321 formed thereon so that a wire can pass through the hole 321 and be soldered onto the connector. Said housing 4, typically made of plastic material, has two broader sides separated by a series of narrower sides and one narrower side of the housing 4 being opened for the purpose of inserting said fuse block 2 into said housing 4. A pair of notches 41, 41*a* formed respectively on the opened side of both broader sides have two longitudinal slots 43, 44 extended from the closed ends of the notches 41, 41*a*. One of the longitudinal slots 44 formed on the broader side surface 42 has a wider portion 40 connected with the notch 41 so as to let said connectors 32 pass through. The longitudinal slot 44 is split by a pair of lateral slots 45, 46 which are perpendicular to the longitudinal slot 44 and the arrow 100. A first pair of detents 451,461 formed respectively on one side of the slots 45,46 prevent the connectors 32 from moving laterally as shown in FIG. 4. A pair of fixing plugs 47,48 extend outwardly from each closed end of the lateral slot respectively, and each closed end of said slot extends so as to pass through the one corresponding plug forming a gap in the center of the corresponding plug. The fixing plug 47 has a cylindrical pole 471 protruding from the broader side surface 42 and a half round head 472 (FIG. 6) axially extending from the cylindrical pole 471 with the radil width larger than that of the cylindrical pole 471. The fixing plug 48 is of the same construction. A second pair of detents 49 formed on the inside surface of the other broader side is parallel to the lateral slots 45,46 so that the clip portion 31 will not move toward the opened side of the housing 4.

Figure 5:
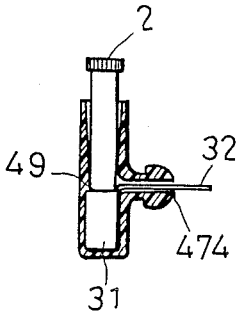
FIG. 5 is a cross section view of the housing of FIG. 3 fitted with a pair of female terminals in accordance with the present invention.

Referring to FIG. 4 and 5, one of the pair of female terminals 3 comprising the clip portion 31 and the connector 32 is fitted into the gap 474 of the fixing plug 47 of the housing 4 by passing through the notch 41, the wider portion 40 of the longitudinal slot 44, the lateral slot 45 and the connector 32 extending through the fixing plug 47. Thus, the clip portion 31 of the female terminal 3 will be fixed by a first detent 451 and the connector 32 of the female terminal will be fixed by a second detent 49 so as to prevent lateral and longitudinal movement of the female terminal. The other female terminal can be fitted into the fixing plug 48 in a similar manner. The fuse block 2 then plugs into the housing 4 with the pair of male terminals 22 inserting into the clip portion 31 of the pair of female terminals.

Figure 6:
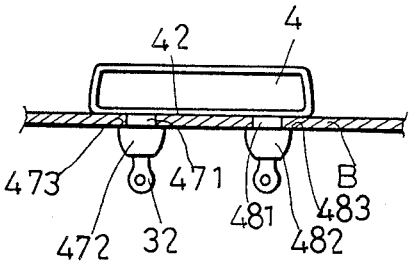
FIG. 6 is an elevational view of the fuse holder of FIG. 3 fitted onto a board, viewed from the rear side of the housing.

Referring to FIG. 6, the fuse holder of the present invention is fitted onto a board B by pressing the half round heads 472, 482 of the pair of fixing plugs 47, 48 through a pair of predetermined holes on the board B. The broader side surface 42 of the housing 4 is in contact with one side of the board B and the cylindrical poles 471, 481 are in the pair of holes. The other side of the board B is in contact with the bottom surface 473, 483 of the pair of half round heads 47, 48, respectively, and the connectors 32 extend through the pair of fixing plug 47, 48 so as to be soldered with a wire.

The fuse 21 of the fuse block 2 when fitted in the housing 4 can be seen at the notch 41 of the housing 4 and the fuse block 2 itself can be pulled out easily from the housing 4 by hand.

While I have described a preferred embodiment of the herein invention, numerous modifications, alternate embodiments, and alternate materials may be contemplated by those skilled in the art. It is envisioned that all such alternate embodiments are considered to be within the scope of the present invention as defined by the appended claims.

What I claim is:

1. A fuse holder for holding a flat-type fuse block having a flat body which has two broader sides separated by a series of narrower sides, a pair of male terminals, vertically and outwardly protruding via one said narrower side of the flat body from the inside thereof, and a fuse disposed inside said flat body and connected between the pair of male terminals, comprising:

a housing adapted to receive said fuse block and said pair of male terminals therein, said housing being hollow and flat with two broader sides separated by a series of narrower sides, one said narrower side of said housing being open to enable said fuse block to be inserted thereinto, one said broader side of the housing having an elongated slot with two ends substantially parallel to the opened side of said housing and a notch communicating between said slot and said open side of said housing;

only one pair of female terminals disposed within said housing and adapted to mate with said pair of male terminals, each said female terminal having a clip portion for clamping one of said male terminals and a connector portion extending at an approximate right angle from said clip portion and passing through said slot of said housing, said connector portions having been inserted into said slot via said notch, said clip portion being positioned substantially parallel to the two broader sides of the housing.

2. The fuse holder as claimed in claim 1, wherein said housing further comprises a pair of fixing plugs formed in said two ends of the slot, each end of said slot extending to pass through one of the corresponding plugs.

3. The fuse holder as claimed in claim 2, wherein each said fixing plug has a pole portion protruding outwardly from said housing and a head portion axially extending from the pole portion, the radial width of said head portion being larger than that of said pole portion.

4. The fuse holder as claimed in claim 2, wherein said connectors are respectively received in said fixing plugs and said slot has a first pair of detents formed at an interface of the notch and said slot so as to prevent said connectors from escaping from said fixing plug, and a second pair of detents formed on the inside surface of said housing parallel to said slot to prevent said connectors from moving toward the opened side of said housing.

5. The fuse holder as claimed in claim 4, wherein said fuse block which is fitted in said housing has a transparent portion which overlaps said notch of said housing so that said fuse can be seen within said transparent portion.

* * * * *